US009206495B2

(12) United States Patent
Bampton

(10) Patent No.: US 9,206,495 B2
(45) Date of Patent: Dec. 8, 2015

(54) SUPERALLOY POWDER, METHOD OF PROCESSING, AND ARTICLE FABRICATED THEREFROM

(75) Inventor: Clifford C. Bampton, Thousand Oaks, CA (US)

(73) Assignee: AEROJET ROCKETDYNE OF DE, INC., Canoga Park, CA (US)

( * ) Notice: Subject to any disclaimer, the term of this patent is extended or adjusted under 35 U.S.C. 154(b) by 1881 days.

(21) Appl. No.: 12/407,002

(22) Filed: Mar. 19, 2009

(65) Prior Publication Data

US 2010/0236666 A1 Sep. 23, 2010

(51) Int. Cl.

| | |
|---|---|
| ***C22C 19/03*** | (2006.01) |
| ***C22C 32/00*** | (2006.01) |
| ***C22C 1/04*** | (2006.01) |
| ***C22C 1/10*** | (2006.01) |
| *C23C 8/24* | (2006.01) |

(52) U.S. Cl.

CPC ..... *C22C 32/0068* (2013.01); *C22C 1/0433* (2013.01); *C22C 1/1084* (2013.01); *B22F 2998/10* (2013.01)

(58) Field of Classification Search

CPC .. C22C 1/0433; C22C 1/1084; C22C 32/0068
USPC ..... 148/207, 317
See application file for complete search history.

(56) References Cited

U.S. PATENT DOCUMENTS

| | | | | |
|---|---|---|---|---|
| 4,043,839 | A | 8/1977 | Hartline, III et al. | |
| 4,082,581 | A | 4/1978 | Ghosh | |
| 4,627,959 | A * | 12/1986 | Gilman et al. | 419/61 |
| 4,708,742 | A | 11/1987 | Wilson | |
| 4,890,784 | A | 1/1990 | Bampton | |
| 5,682,132 | A * | 10/1997 | Hiroyoshi et al. | 340/407.1 |
| 5,908,486 | A | 6/1999 | Flinn et al. | |
| 6,042,631 | A | 3/2000 | Kondoh et al. | |
| 6,210,633 | B1 | 4/2001 | Kratt et al. | |
| 6,848,163 | B2 | 2/2005 | Bampton et al. | |
| 6,902,699 | B2 | 6/2005 | Fritzemeier et al. | |
| 7,235,118 | B2 | 6/2007 | Bouaricha et al. | |
| 7,241,328 | B2 | 7/2007 | Keener | |
| 7,344,675 | B2 | 3/2008 | VanDaam et al. | |
| 2007/0098977 | A1 * | 5/2007 | Iorio et al. | 428/332 |
| 2007/0151639 | A1 | 7/2007 | Oruganti | |
| 2008/0066831 | A1 | 3/2008 | Srivastava | |

OTHER PUBLICATIONS

Rodriguez R et al.: "Tensile and creep behavior of cryomilled Inco 625" Acta Materialia Elsevier UK, vol. 51, No. 4, Feb. 25, 2003, pp. 911-929, XP002590324, ISSN: 1359-6454.

Chung K H et al.: "Grain growth behavior of cryomilled Inconel 625 powder during isothermal heat treatment", Metallurgical and Materials Transactions A (Physical Metallurgy and Materials Science) Minerals, Metals & Mater. Soc. & Asm Int. USA, vol. 33A, No. 1, Jan. 2002, pp. 125-134, XP002590325, ISSN: 1073-5623.

Extended EP Search Report mailed on Jul. 19, 2010 for EP 10250518.

Keynote Address—MA Alloys for Aerospace Applications, I.C. Elliott, G. A. J. Hack, Inco Alloys International, Inc., United Kingdom, 15-24, 1990.

* cited by examiner

*Primary Examiner* — Rebecca Lee
(74) *Attorney, Agent, or Firm* — Joel G Landau

(57) ABSTRACT

A method of processing a superalloy powder includes mechanically alloying nitrogen with superalloy powder particles having at least one nitride-forming element such that each superalloy powder particle includes a microstructure having nitrogen dispersed throughout the microstructure. The powder may then be formed into an article having nitride regions dispersed throughout.

8 Claims, 1 Drawing Sheet

SUPERALLOY POWDER, METHOD OF PROCESSING, AND ARTICLE FABRICATED THEREFROM

BACKGROUND

This disclosure relates to dispersion-strengthened superalloys.

Conventional superalloys are known and used in high temperature applications, such as for aerospace applications. Typically, superalloys exhibit high strength from precipitation hardening or solid solution strengthening. However, a drawback of these conventional alloys is that the strength rapidly declines at temperatures above about 1300° F. (704° C.) because of thermal instability of the microstructure, which may be undesirable in many aerospace applications where there is exposure to higher temperatures.

More recently, another method of treating a superalloy has been employed to provide a more stable microstructure that facilitates maintaining a greater degree of strength above 1300° F. This method includes gas nitriding a relatively thin sheet of the superalloy to incorporate nitrogen into the microstructure and ultimately form nitrides that increase strength. The nitrides are thermally stable above 1300° F. However, a drawback of gas nitriding is that this method is limited to relatively thin sheets because incorporating the nitrogen into the superalloy relies on diffusion of nitrogen through the superalloy. Even a relatively thin superalloy sheet having a thickness under two millimeters may require a processing time of 48 hours or more to incorporate a desired amount of nitrogen. Therefore, gas nitriding is not economic or suitable for thick, three-dimensional parts.

SUMMARY

An exemplary method of processing a superalloy powder includes mechanically alloying nitrogen with superalloy powder particles having at least one nitride-forming element such that each superalloy powder particle includes a microstructure having nitrogen dispersed throughout the microstructure.

An exemplary superalloy powder includes a plurality of superalloy powder particles having at least one nitride-forming element. Each superalloy powder particle includes a microstructure having nitrogen dispersed throughout the microstructure.

An exemplary article fabricated from a superalloy powder includes a solid body formed of a superalloy. The solid body includes nitride regions dispersed throughout the solid body.

BRIEF DESCRIPTION OF THE DRAWINGS

The various features of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
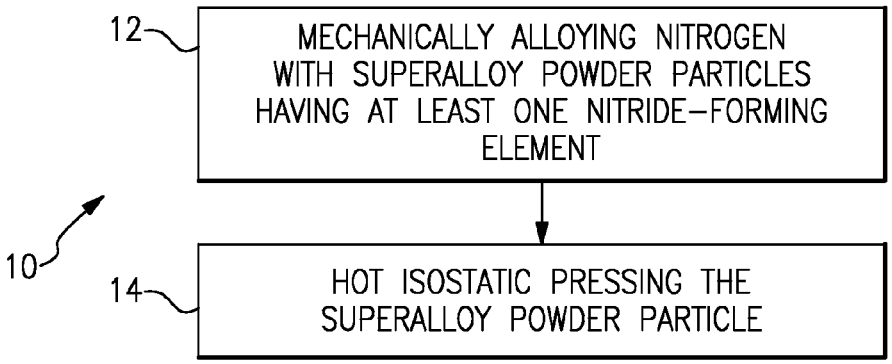
FIG. 1 illustrates an example method of processing a superalloy powder.

FIG. 1 illustrates an example method 10 for processing a superalloy powder to provide a nitride dispersion-strengthened superalloy for high temperature applications. As an example, the term "superalloy" may refer to any alloy composition that is designed to exhibit excellent mechanical strength and creep resistance at temperatures above about 1100° F. (593° C.) and good resistance to corrosion and oxidation.

The method 10 includes a mechanical alloying step 12 in which nitrogen is mechanically alloyed with superalloy powder particles having at least one nitride-forming element. The phrase "mechanical alloying" refers to any technique that physically deforms the superalloy powder particles to incorporate nitrogen into a microstructure of the superalloy powder particles.

As an example, the mechanical alloying step 12 may include milling the superalloy powder particles in an attritor to incorporate the nitrogen. The attritor may include a chamber for containing a mechanical milling material and a nitrogen source along with the superalloy powder particles. The nitrogen source may be liquid nitrogen such that the mechanical alloying step 12 is a cryo-milling process.

The mechanical milling material may be milling balls that, when agitated by the attritor through rotation of the attritor arms within the chamber, mechanically deform the superalloy powder particles. Other shapes of mechanical milling materials may alternatively be used.

The mechanical milling material may flatten and fracture the superalloy powder particles. Inter-atomic forces adhere nitrogen to the surfaces of the superalloy powder particles, such as to freshly formed surfaces from fractures. Additional milling mechanically fuses the flattened or fractured superalloy powder particles together into agglomerates with the nitrogen embedded between the fused particles. Additional mechanical milling flattens and fractures the agglomerates to restart the cycle of incorporating nitrogen. The mechanical alloying thereby uniformly disperses the nitrogen. At the conclusion of the mechanical alloying step 12, each individual superalloy powder particle or agglomerate may include a lamellar structure from the repeated flattening and bonding.

The duration of the mechanical milling may be predetermined to control the amount of nitrogen incorporated into the superalloy powder particles. Shorter times may be used to incorporate less nitrogen and longer times for more nitrogen. Given this description, one of ordinary skill in the art will be able to determine suitable milling times to meet their particular needs. The superalloy powder particles may include about 0.5-10 wt % of the nitrogen. In a further example, the superalloy powder particles include about 6-9 wt % of nitrogen. Using about 7.5 wt % of nitrogen may be favorable to achieve a desired nitride dispersion-strengthening effect in the final article.

Optionally, the method 10 may also include additional processing steps to form the superalloy powder particles or agglomerates into a net shape article. As an example, the method 10 may include a forming step 14 that includes hot isostatic pressing of the superalloy powder particles to form the article. The hot isostatic pressing may include encasing the superalloy powder particles in a can and degassing the interior of the can to remove any non-alloyed nitrogen from the powder particles. The can and powder may then be isostatically compressed at an elevated temperature below the melting temperature of the superalloy to fuse or sinter the particles together and form the net shape article. As known, portions of the can may be thinner than other portions such that the isostatic pressure selectively deforms the thinner portions more than the thicker portions to mold the powder particles into a desired three dimensional shape. The can may then be later removed mechanically or chemically in a known manner. Other processing steps, such as machining or welding, may follow to finish the article.

At the elevated temperatures of the forming step 14 the nitrogen alloyed into the microstructure of the superalloy powder particles diffuses and compounds with the nitride-forming elements of the superalloy to form nitride regions that are dispersed throughout the body of the article. In prior nitriding processes that rely on gas diffusion, dispersion is limited by relatively long diffusion distances from free surfaces into the superalloy. However, the uniform dispersion of nitrogen within the superalloy powder particles obtained through mechanical alloying in the method 10 reduces the diffusion distances and facilitates achieving a uniform dispersion of the nitride regions in the superalloy powder particles and ultimately throughout the article.

The composition of the superalloy powder particles used in the method 10 may be selected based on the needs of the particular article. As an example, the superalloy powder particles may be selected from cobalt-based superalloy powder particles, nickel-based superalloy powder particles, nickel-iron-based superalloy powder particles, or combinations thereof. For instance, the superalloy powder particles may be HAYNES® 188, HAYNES® 230, or Alloy 625.

In some examples, cobalt-based superalloy powder particles may be desirable because of a relatively high diffusivity of nitrogen in cobalt compared to nickel and iron. An example cobalt-based superalloy for use in the method 10 includes a composition of about 28 wt % chromium, about 9 wt % nickel, about 21 wt % iron, about 1.25 wt % titanium, about 1 wt % niobium, and a remainder of cobalt and minor alloying elements.

Figure 2:
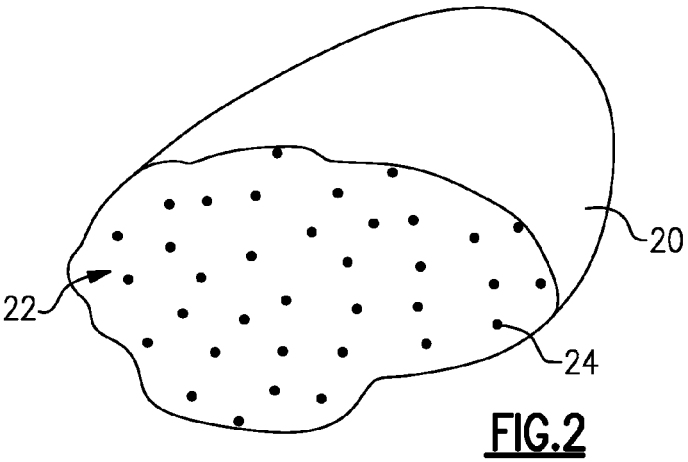
FIG. 2 illustrates a sectioned superalloy powder particle.

FIG. 2 illustrates an example of a section of a superalloy powder particle 20 that may be fabricated using the method 10 described above. The sectioned surface of the superalloy powder particle 20 illustrates a microstructure 22 that is representative of the entire superalloy powder particle 20. The microstructure 22 includes nitride regions 24 that are dispersed throughout the microstructure 22. For instance, the nitride regions 24 may be nanosized and relatively uniformly dispersed throughout the superalloy powder particle 20. The term "nanosized" refers to the nitride regions 24 being no more than about twenty nanometers in any maximum dimension. However, it is to be understood that the nitride regions 24 may be on the order of only a few nanometers or smaller.

The nitride regions 24 are compounds of nitrogen and the nitride-forming element(s) from the superalloy powder particles 20. For instance, the nitride-forming elements may be titanium, niobium, vanadium, tantalum, zirconium, or combinations thereof. These nitride-forming elements form relatively stable nitride regions 24 above temperatures exceeding 1300° F. (704° C.) that dispersion-strengthen the superalloy powder particles 20. As an example, the superalloy powder particles may include up to about 10 wt % of the nitride-forming element(s). In some examples, the superalloy powder particles may include about 0.5-4 wt % of the nitride-forming element. However, in other examples, the superalloy powder particles 20 may include an amount greater than 4 wt % of the nitride-forming element, depending on what amount of the nitride regions 24 are desired in the superalloy powder particles 20.

Using the method 10, amounts greater than 4 wt % of the nitride-forming element provide a greater strengthening effect through formation of more or larger nitride regions 24. In other nitriding methods that utilize gas diffusion of sheets of superalloy material, utilizing such high amounts (i.e., >4 wt %) of nitride-forming elements limits the deformability of the sheets and therefore is not used in such high amounts. Thus, the method 10 for producing the superalloy powder particles 20 may be used to obtain a greater strengthening effect in the article from the nitride regions 24 because the hot isostatic pressing of the forming step 14 does not rely on deformation of the superalloy powder particles 20 as do superalloy sheets.

Figure 3:
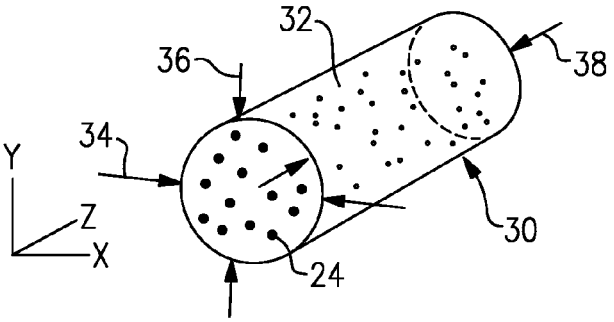
FIG. 3 illustrates an example article fabricated from a superalloy powder.

FIG. 3 illustrates an example article 30 that may be formed from the superalloy powder particles 20. The particular shape of the article 30 that is shown is only an example to demonstrate that the method 10 may be used to fabricate relatively thick, nitride-dispersion strengthened articles. The article 30 may be formed in any desired shape, such as a scramjet component, a nozzle component for a jet engine, a component for a power generation system, or other type of component that is intended to be used in a structural capacity at elevated temperatures.

In this example, the article 30 includes a solid body 32 having a width 34 along an X-direction, a height 36 along a Y-direction, and a depth 38 along a Z-direction. In this case, the article 30 has been formed using the method 10, including the forming step 14. In this regard, the article 30 includes a plurality of the superalloy powder particles fused together in a desired shape. Thus, the article 30 includes the nitride regions 24 dispersed throughout the solid body 32. That is, in contrast to many gas diffusion nitriding treatments, the nitride regions 24 are homogonously dispersed throughout the article 30, and do not have a greater concentration near the free surfaces. Any article having a considerable width 34, height 36, and depth 38 may be fabricated using the method 10 to obtain the uniform dispersion of the nitride regions 24 throughout. In some examples, each of the width 34, height 36, and depth 38 may be greater than two millimeters and yet still include a uniform dispersion of the nitride regions 24. In other examples, the width 34, height 36, and/or depth 38 may be 5 mm, 10 mm, or 50 mm in dimension, or other dimensions that are within the capability of hot isostatic pressing.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A superalloy powder, comprising:

a plurality of superalloy powder particles having at least one nitride-forming element, each superalloy powder particle including a microstructure having nitrogen dispersed throughout the microstructure, wherein the plurality of superalloy powder particles includes about 6-10 wt % of the nitrogen.

2. The superalloy powder as recited in claim 1, wherein the plurality of superalloy powder particles are selected from a group consisting of cobalt-based superalloy powder particles, nickel-based superalloy powder particles, nickel-iron-based superalloy powder particles, and combinations thereof.

3. The superalloy powder as recited in claim 1, wherein the nitrogen is present in nanosized nitride regions that are uniformly dispersed throughout the microstructure.

4. The superalloy powder as recited in claim 1, wherein a superalloy of the superalloy powder particles includes a composition of about 28 wt % chromium, about 9 wt % nickel, about 21 wt % iron, about 1.25 wt % titanium, about 1 wt % niobium, and a remainder of cobalt and any minor alloying elements.

5. The superalloy powder as recited in claim 1, wherein the plurality of superalloy powder particles is nickel-based superalloy powder particles.

6. The superalloy powder as recited in claim 1, wherein the plurality of superalloy powder particles is nickel-iron-based superalloy powder particles.

7. The superalloy powder as recited in claim 1, wherein the plurality of superalloy powder particles has greater than 4 wt % of the at least one nitride-forming element.

8. The superalloy powder as recited in claim 1, wherein the plurality of superalloy powder particles includes about 7.5-9 wt % of the nitrogen.

* * * * *